US009347704B2

(12) United States Patent
Mok et al.

(10) Patent No.: US 9,347,704 B2
(45) Date of Patent: May 24, 2016

(54) REFRIGERATED DRAWER AND DIVIDER ASSEMBLY THEREFOR

(71) Applicant: BSH Home Appliances Corporation, Irvine, CA (US)

(72) Inventors: Andy Mok, Stanton, CA (US); Laura Ringemann, Munich (DE)

(73) Assignee: BSH Home Appliances Corporation, Irvine, CA (US)

( * ) Notice: Subject to any disclaimer, the term of this patent is extended or adjusted under 35 U.S.C. 154(b) by 0 days.

(21) Appl. No.: 14/155,415

(22) Filed: Jan. 15, 2014

(65) Prior Publication Data

US 2015/0198364 A1 Jul. 16, 2015

(51) Int. Cl.

| | |
|---|---|
| ***A47B 96/04*** | (2006.01) |
| ***A47B 88/00*** | (2006.01) |
| ***F25D 25/02*** | (2006.01) |

(52) U.S. Cl.

CPC ..... *F25D 25/025* (2013.01); *Y10T 29/49826* (2015.01)

(58) Field of Classification Search

CPC .. A47B 88/20; A47B 2088/202; A47F 5/005; F25D 25/025; B65D 25/06

USPC ..... 312/401, 404, 348.3, 402; 220/501, 220/528, 530, 529, 533; 211/184

See application file for complete search history.

(56) References Cited

U.S. PATENT DOCUMENTS

| | | | | | |
|---|---|---|---|---|---|
| 2,483,769 | A | * | 10/1949 | Hickey | 312/140.3 |
| 2,504,466 | A | * | 4/1950 | Stolzoff | 211/11 |
| 2,820,684 | A | * | 1/1958 | Zadek et al. | 312/140.3 |
| 2,884,139 | A | * | 4/1959 | Dunham | 211/184 |
| 3,468,592 | A | * | 9/1969 | Madey | 312/140.3 |
| 3,830,169 | A | * | 8/1974 | Madey | 108/61 |
| 4,209,093 | A | * | 6/1980 | Soderland | 206/425 |
| 4,538,737 | A | * | 9/1985 | Delaney | 211/71.01 |
| 5,052,580 | A | * | 10/1991 | Khoury | 220/505 |
| 5,072,835 | A | * | 12/1991 | Price et al. | 211/40 |
| 5,443,160 | A | * | 8/1995 | Tortorella et al. | 206/561 |
| 5,664,691 | A | * | 9/1997 | Boivin-Paradis | 211/184 |
| 6,290,077 | B2 | * | 9/2001 | Sosso | 211/189 |
| D507,915 | S | * | 8/2005 | Nagel | D6/706 |
| 7,082,783 | B2 | * | 8/2006 | Uihlein et al. | 62/441 |
| 7,140,705 | B2 | * | 11/2006 | Dressendorfer et al. | 312/348.3 |

(Continued)

FOREIGN PATENT DOCUMENTS

| | | | |
|---|---|---|---|
| CN | 202536034 | U | 3/2013 |
| KR | 20080055255 | A | 6/2008 |

OTHER PUBLICATIONS

Sub-Zero, Sub-Zero Pro 48 Refrigerator, online: Subzero-Wolf.com, publication date May 2011.

(Continued)

*Primary Examiner* — Daniel J Troy
*Assistant Examiner* — Kimberley S Wright
(74) *Attorney, Agent, or Firm* — James E. Howard; Andre Pallapies

(57) ABSTRACT

A divider assembly for a refrigerated drawer includes a plurality of dividers to form a plurality of adjustable storage compartments. Each of the dividers has a slot formed therein to receive a guide portion of another divider. The guide portions of a first divider are configured to slidably engage the guide portions of a second divider. The slots form openings which allow a cooling airflow to circulate between the storage compartments.

22 Claims, 11 Drawing Sheets

(56) References Cited

U.S. PATENT DOCUMENTS

| | | | | |
|---|---|---|---|---|
| 7,296,433 | B2 | 11/2007 | Uihlein et al. | |
| 7,874,176 | B2 * | 1/2011 | Uihlein et al. | 62/441 |
| 7,959,390 | B2 * | 6/2011 | Gorski | 410/121 |
| 8,167,150 | B2 * | 5/2012 | Chu | 211/184 |
| 8,397,937 | B2 * | 3/2013 | Preschke et al. | 220/529 |
| 8,590,992 | B2 * | 11/2013 | Lim et al. | 312/404 |
| 8,733,867 | B2 * | 5/2014 | Hwang et al. | 312/402 |
| 8,789,903 | B2 * | 7/2014 | Lim et al. | 312/404 |
| 8,833,881 | B2 * | 9/2014 | Manniso et al. | 312/348.3 |
| 8,893,903 | B2 * | 11/2014 | Nilsson | 211/184 |
| 2002/0030091 | A1 * | 3/2002 | McCarthy | 229/120.36 |
| 2009/0230832 | A1 * | 9/2009 | Shin | 312/404 |
| 2010/0072154 | A1 * | 3/2010 | Johnson | 211/184 |
| 2012/0319550 | A1 * | 12/2012 | Manniso et al. | 312/348.3 |
| 2013/0099651 | A1 * | 4/2013 | Hwang et al. | 312/404 |
| 2014/0265802 | A1 * | 9/2014 | Wilcox et al. | 312/404 |

OTHER PUBLICATIONS

General Electric Co., ZIDI240 double-Drawer Built-In Refrigerator, online: GEAppliances.com, publication date Aug. 2007.

Summit Appliance, Dual-Drawer Refrigerator, online: SummitAppliacne.com, publication date unknown accessed Jul. 19, 2013.

Samsung, Flex Zone Mid Convertible Drawer, online: Smasung.com, publication date 2013.

AGA Marvel, 24" Marvel Refrigerated Drawers, online: MarvelRefrigeration.com, publication date 2013.

H&h System, Inc., Organization in the Refrigerator, online: publication date unknown accessed Jul. 19, 2013.

Amana, Amana ABB2224WES Refrigerator Review, online: Refrigerator.Reviewed.com, publication date May 21, 2013.

* cited by examiner

REFRIGERATED DRAWER AND DIVIDER ASSEMBLY THEREFOR

TECHNICAL FIELD

The present technology relates generally to devices for space organization, and particularly to dividers for drawers (e.g., a refrigerated drawer).

BACKGROUND

Refrigerated drawers can be found in residential and commercial applications both as stand alone or built in refrigerated units, for example. Drawers are commonly used in conjunction with a larger refrigerated compartment. For example, a freezer compartment in a refrigerator may actually be a slidable drawer. Dividers are sometimes provided within refrigerated drawers to separate food items within the drawer. However, known systems have limited flexibility in arranging the space within a refrigerated drawer.

SUMMARY

One aspect of the technology relates to a divider assembly (e.g., for a refrigerated drawer space) which provides flexibility in the arrangement of the drawer space.

Another aspect of the technology relates to a divider assembly for a refrigerated drawer having an arrangement which ensures that a cooling airflow circulates between all of the storage compartments of the drawer.

One exemplary divider assembly comprises at least one first divider having an elongate substantially planar configuration and at least one first slot extending through the first divider, and at least one second divider having an elongate substantially planar configuration and at least one second slot extending through the second divider. A portion of the first divider is configured to extend through the second slot, and a portion of the second divider is configured to extend through the first slot such that the first divider is adjustable relative to the second divider along the second slot and the second divider is adjustable relative to the first divider along the first slot.

One exemplary method of dividing a drawer space comprises providing at least one first divider including at least one first slot in a drawer space and providing at least one second divider including at least one second slot in the drawer space. The method further comprises positioning a portion of the first divider to extend through the second slot and positioning a portion of the second divider to extend through the first slot. Additionally, the method comprises adjusting the first divider relative to the second divider along the second slot and/or adjusting the second divider relative to the first divider along the first slot.

One exemplary refrigeration device comprises a drawer to store items and a plurality of dividing walls to separate the drawer into at least three adjustable storage compartments. Each of the dividing walls includes an opening formed therein to slidably receive a portion of another dividing wall, and the openings are configured such that a cooling airflow is allowed to circulate through the at least three storage compartments.

Other aspects, features, and advantages of this technology will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various embodiments of this technology. In such drawings:

FIG. 5-1 is an enlarged detail showing the length divider positioned in a locater member;

FIG. 6-1 is an enlarged detail showing the example locator member of FIG. 6;

DETAILED DESCRIPTION OF ILLUSTRATED EXAMPLES

The following description is provided in relation to several examples (most of which are illustrated) which may share some common characteristics and features. It is to be understood that one or more features of any one example may be combinable with one or more features of the other examples. In addition, any single feature or combination of features in any of the examples may constitute additional examples.

Figure 1:
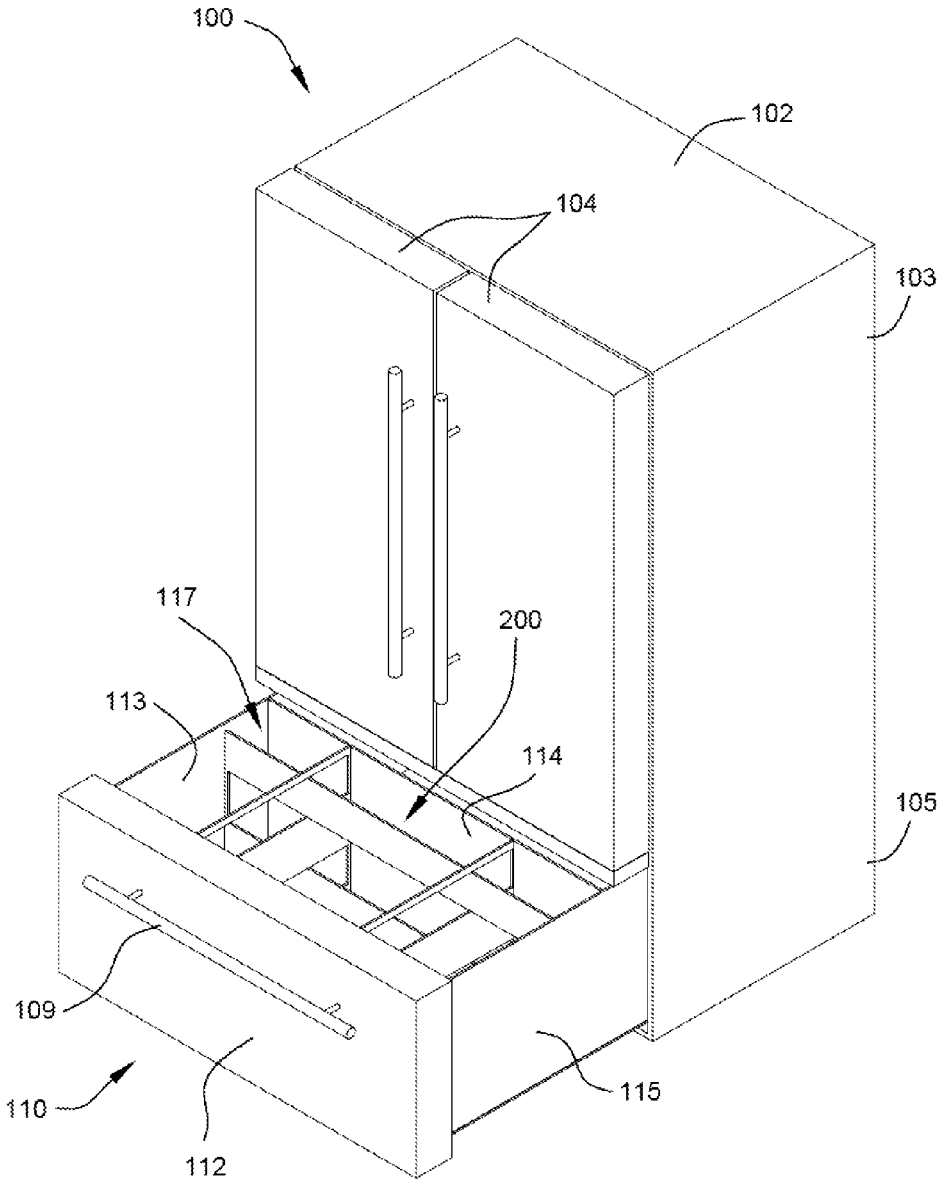
FIG. 1 is a perspective view of a refrigeration device according to an example of the disclosed technology.
Figure 2:
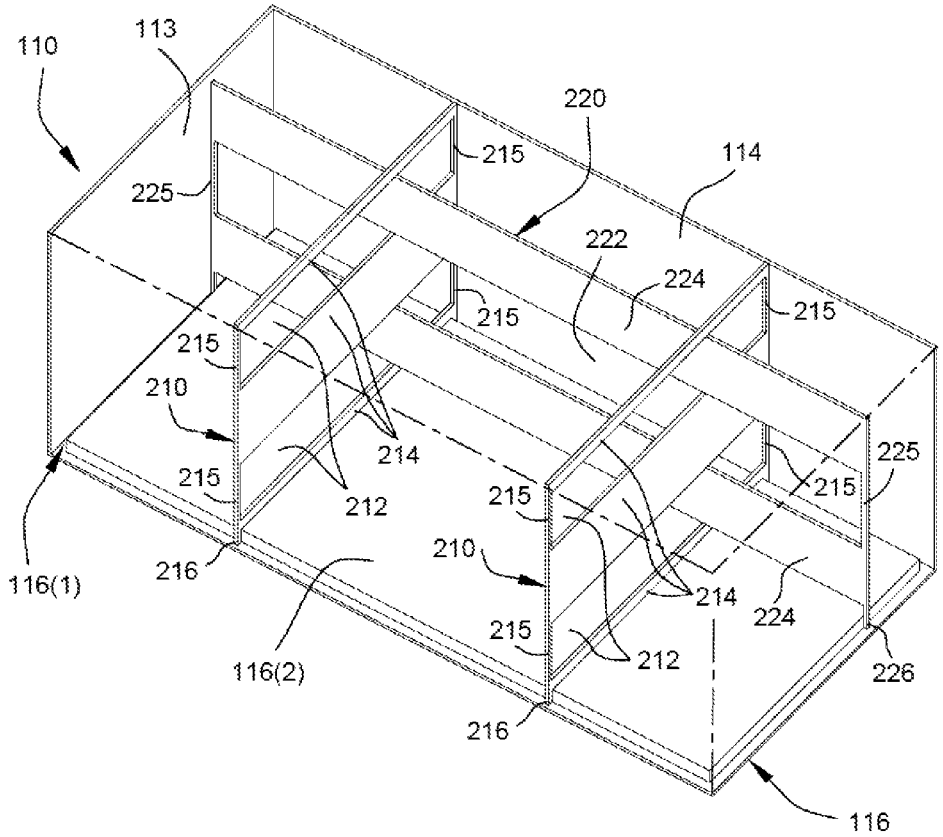
FIG. 2 is a perspective view of an example drawer of the refrigeration device of FIG. 1.

FIG. 1 shows a refrigerator (e.g., a domestic refrigerator 100) including a housing 102 having a cooling compartment 103 and a freezer compartment 105. Access to the cooling compartment 103 is permitted by doors 104 (e.g., French doors). A drawer 110 is slidably received in the freezer compartment 105. The drawer 110 includes a front wall 112, sidewalls 113, 115, a rear wall 114 and a bottom wall 116, as shown in FIGS. 1 and 2. A handle is disposed on the front wall 112 to facilitate a user in opening/closing the drawer 110.

The refrigerator 100 includes a cooling unit 101 to cool the cooling compartment 103 and the freezer compartment 105. The cooling unit 101 may include an evaporator or other such device to facilitate cooling the refrigerator as well as a fan or other such device to circulate a cooling airflow as those skilled in the art will understand. The housing 102 may include insulation that surrounds an interior of the housing.

As shown in FIG. 1, the drawer includes an interior compartment 117 forming a storage space for accommodating food items. A divider assembly 200 is removably disposed in the interior compartment 117. Those skilled in the art will understand that the divider assembly may be used in other storage spaces (e.g., drawers other than in refrigeration devices).

Referring to FIG. 2, the drawer 110 is shown with the front wall 112 and the sidewall 115 removed for ease of illustration. The divider assembly 200 includes two width dividers 210 and a single length divider 220 which are adjustably disposed relative to one another so as to provided flexibility in the arrangement of the storage space of the interior compartment 117. The width dividers 210 extend in the length direction of the drawer 110 so as to divide the drawer in its width direction. The length divider 220 extends in the width direction of the drawer 110 so as to divide the drawer in its length direction. It is noted that the divider assembly may include a different number of width dividers 210 and/or a different number of length dividers 220 (e.g., between 1 and 5 width dividers 210 and between 1 and 5 length dividers 220).

The dividers 210, 220 may be formed from stainless steel, plastic, glass or any other suitable material. The dividers 210, 220 may be transparent.

Figure 3:
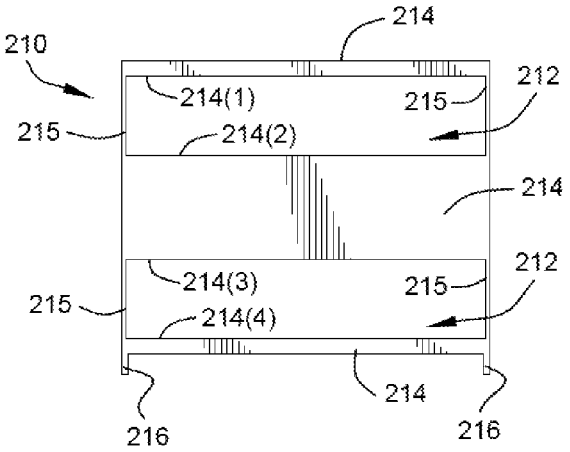
FIG. 3 is a front view of a width divider of the drawer of FIG. 2.

Referring to FIGS. 2 and 3, the width dividers 210 have an elongate substantially planar configuration. As the width dividers have an identical configuration, only one of the width dividers will be described. Slots 212 extend along the length of the width divider 210 and thereby form spaced guide portions 214. The guide portions 214 are connected at end portions thereof by supports 215 so as to allow the slots 212 to extend uninterruptedly for nearly the entire length of the width divider.

The slots 212 of the width divider 210 are configured to slidably receive portions of the length divider 220 to allow the length divider to be adjustably positioned along the length of the drawer 110. As shown in FIG. 3, the guide portions 214 include surfaces 214(1), 214(2), 214(3), 214(4) (e.g., upper and/or lower surfaces thereof) which function as guide surfaces for the length divider 220. That is, the guide surfaces guide the length divider 210 along the slots 212.

In the illustrated example, the guide portions 214 of the width divider 210 include an upper guide portion, a middle guide portion and a lower guide portion; however, more or less guide portions 214 may be provided.

Figure 4:
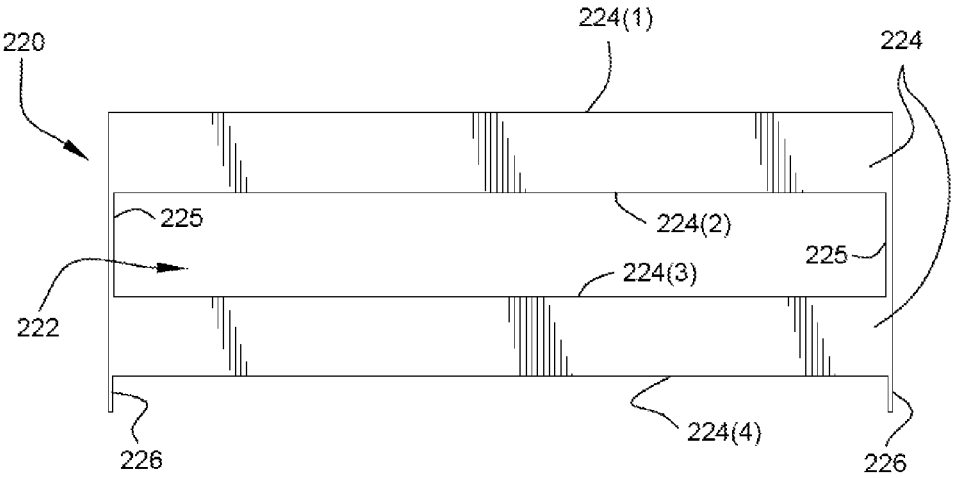
FIG. 4 is a front view of a length divider of the drawer of FIG. 2.

Referring to FIG. 4, the length divider 220 has an elongate substantially planar configuration. A slot 222 extends along the length of the length divider and thereby forms spaced guide portions 224. The guide portions 224 are connected at end portions thereof by supports 225 so as to allow the slot 22 to extend uninterruptedly for nearly the entire length of the length divider 220.

The slot 222 is configured to slidably receive a guide portion 214 (e.g., middle guide portion) of the width divider 210 to allow the width divider 210 to be adjustably positioned along the width of the drawer 110. As shown in FIG. 4, the guide portions 224 include surfaces 224(1), 224(2), 224(3), 224(4) (e.g., upper and/or lower surfaces thereof) which function as guide surfaces for the width divider 210. In other words, the guide surfaces guide movement of the width divider 210 along the length divider 220. In particular, the surfaces 224(1), 224(2), 224(3), 224(4) of the length divider engage respective surfaces 214(1), 214(2), 214(3), 214(4) of the width divider 210 to guide movement of both the length divider 220 and the width divider 210 relative to one another.

The slots 212, 222 may have a different size than shown. Additionally, each of the dividers 210, 220 may include more or less slots than shown.

The bottom wall 116 of the drawer 110 may include a raised floor 116(2), as shown in FIG. 2. The floor may be formed as part of the drawer 110 or may be a removable component thereof. Each side of the floor 116(2) has a length that is shorter than a length of the bottom wall 116 and thereby forms a groove 116(1) on the floor 116 of the drawer.

The width divider 210 may include a pair of feet 216 extending downwardly from a guide portion 214 (i.e., the lower guide portion) at opposing sides of the width divider in the length direction thereof, as shown in FIGS. 2 and 3. The feet 216 are configured to be received in the groove 116(1) and to provide support and stability to the width divider 210. The length divider 220 may include a similar pair of feet 226, as shown in FIGS. 2 and 4. While the dividers 210, 220 may be positioned in a desired relationship relative to one another when the divider assembly 200 is removed from the drawer 110, the dividers 210, 220 may be adjusted while in the drawer as the feet 216, 226 may simply travel along the groove 116(1) when the dividers 210, 220 are adjusted.

Figure 8:
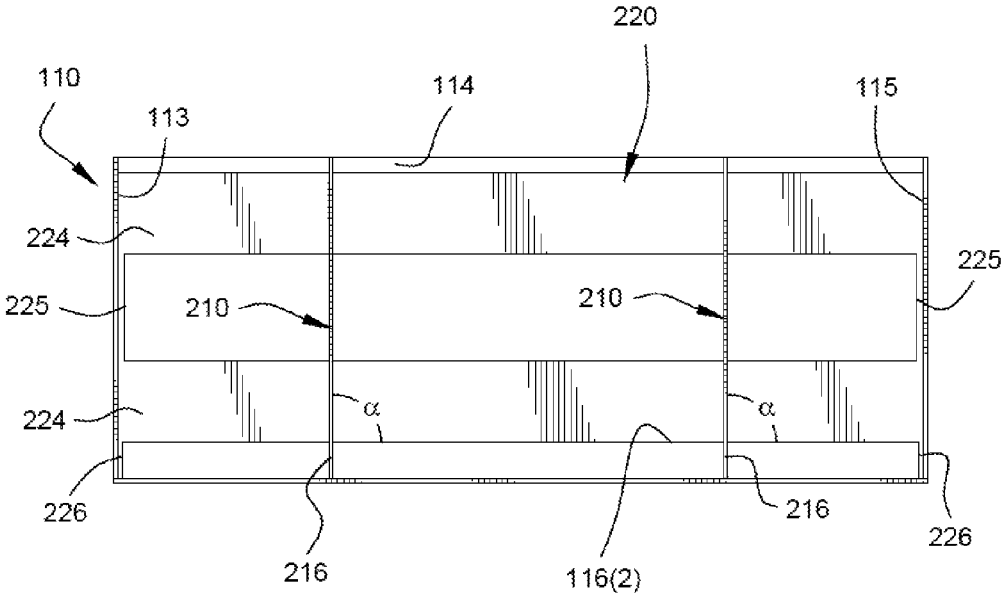
FIG. 8 is a front view of the drawer of FIG. 2.
Figure 9:
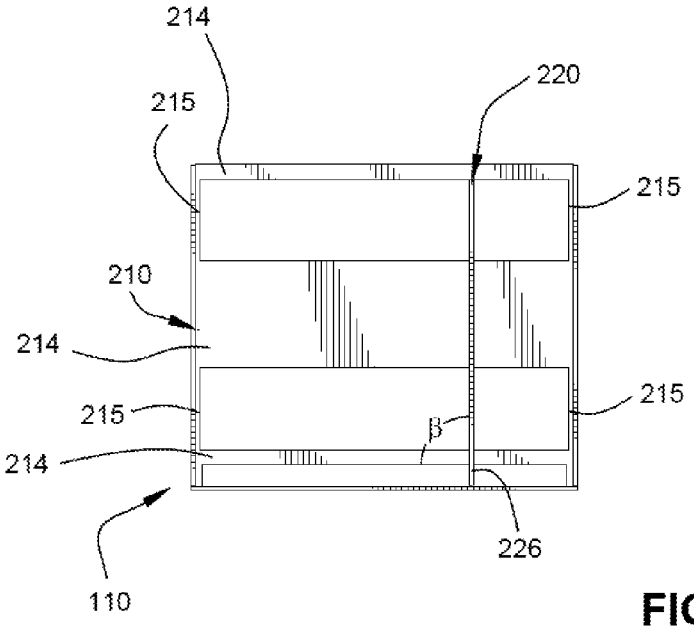
FIG. 9 is a side view of the drawer of FIG. 2.

The width divider 210 and the length divider 220 may be positioned in the drawer with a friction fit (e.g., loose fit, light interference fit, or interference fit) with the front wall 112, sidewalls 113, 115 and/or rear wall 114 of the drawer to aid in maintaining the vertical positioning of the dividers 210, 220. Additionally, or alternatively, the surfaces 224(1), 224(2), 224(3), 224(4) of the length divider may have a friction fit (e.g., loose fit, light interference fit, or interference fit) with the respective surfaces 214(1), 214(2), 214(3), 214(4) of the width divider to facilitate the upright vertical positioning of the divider assembly. As shown in FIGS. 8 and 9, the width divider 210 and the length divider 220 extend at respective angles $\alpha$ and $\beta$ with respect to the floor 116(2). The angles $\alpha$ and $\beta$ are preferably 90°; however, other angles are possible.

Figure 5:
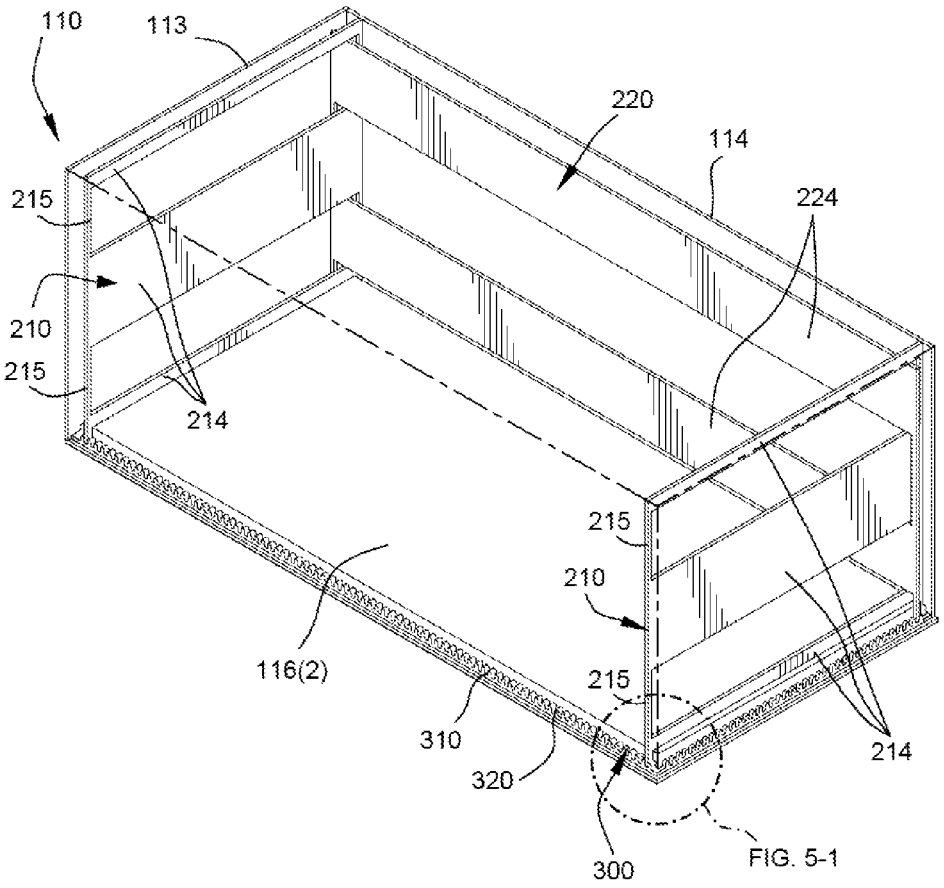
FIG. 5 is a perspective view of another example drawer of the refrigeration device of FIG. 1.
Figures 1, 5:
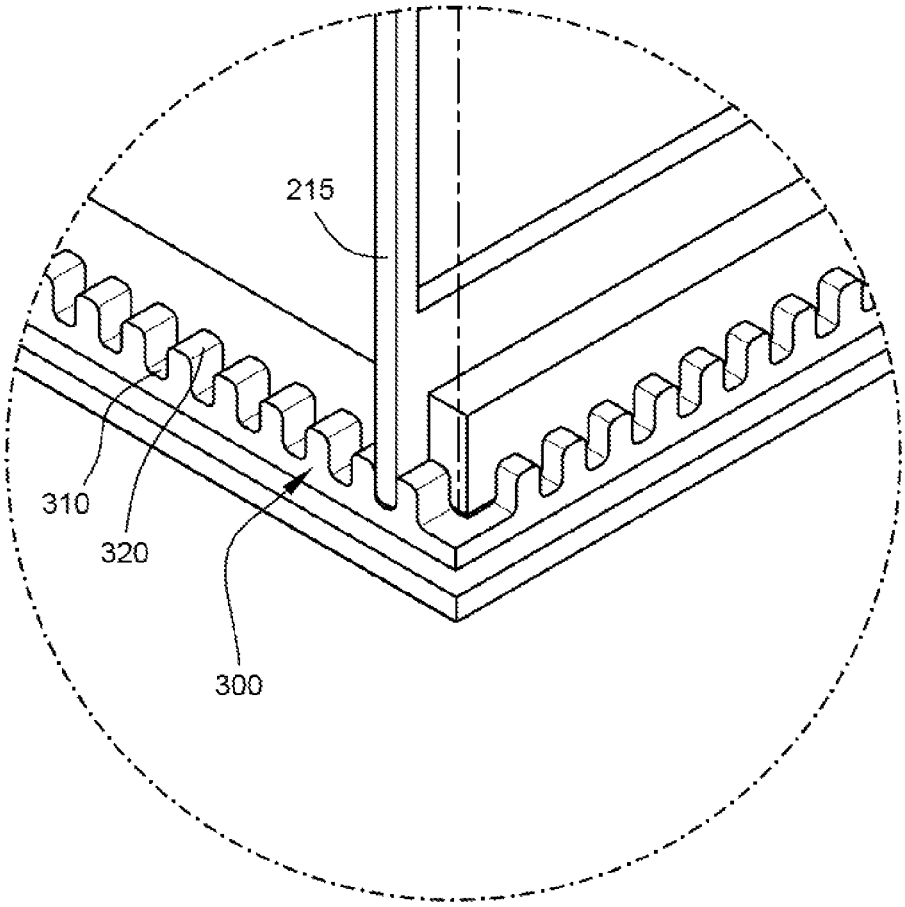

The respective supports 215, 225 of the width divider 210 and the length divider 220 may have relatively small lengths so as to maximize the lengths of the slots 212, 222 and thereby maximize the adjustable range of the dividers. Additionally, the dividers 210, 220 may have a relatively thin construction such that the divider assembly 200 occupies only a relatively small space. This is particularly advantageous when the dividers 210, 220 are moved against the walls of the drawer 110 to create a single undivided storage space, as shown in FIG. 5. In an example, the dividers 210, 220 have a thickness in the range of 1.5 to 6 mm (e.g., 3-5 mm, 2-4 mm, 2-3 mm, or 2 mm).

Figure 6:
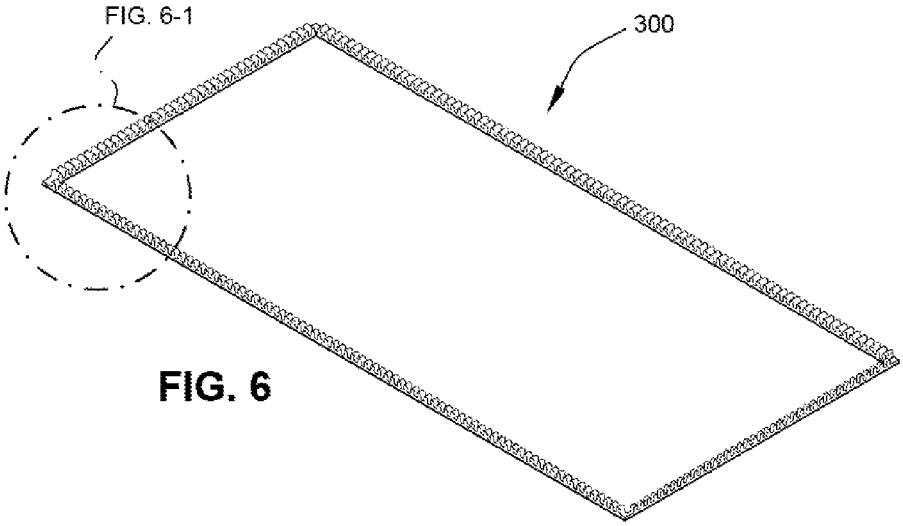
FIG. 6 is a perspective view of an example locator member of the drawer of FIG. 5.
Figures 1, 6:
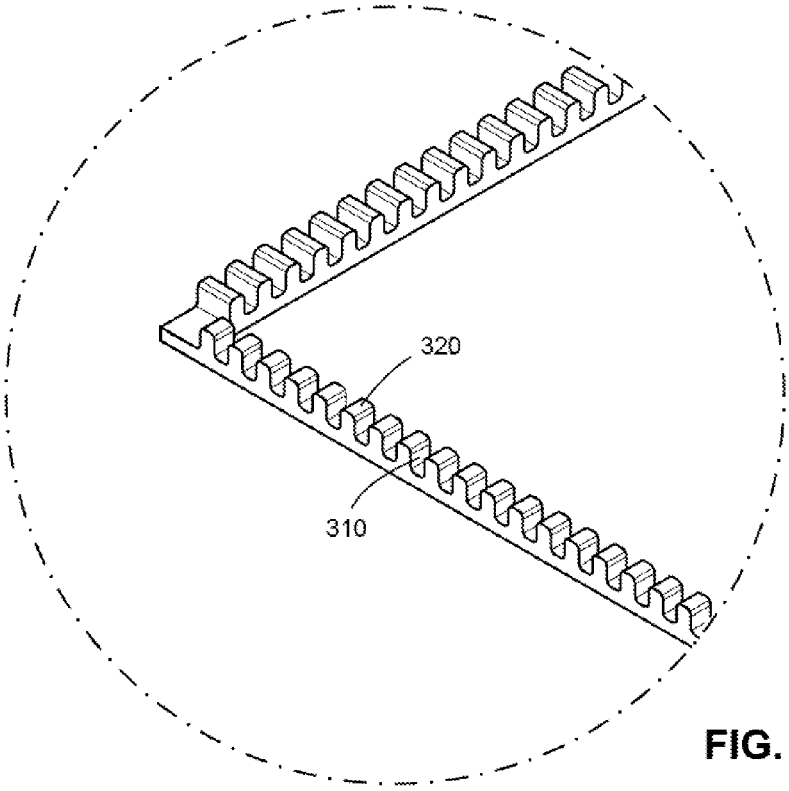
Figure 7:
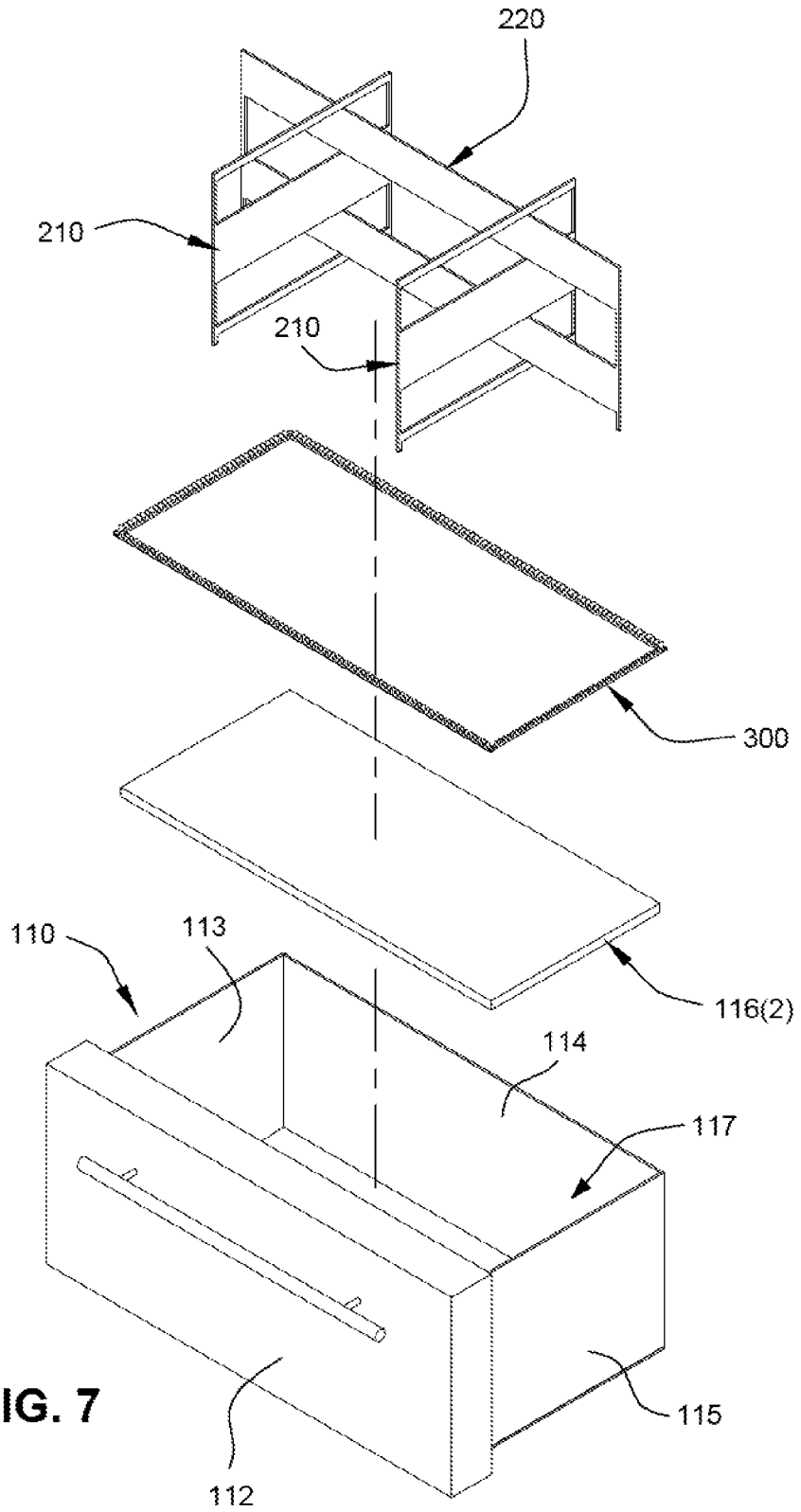
FIG. 7 is an exploded perspective view of an example drawer assembly of the disclosed technology.

In an example, the drawer 110 may include a locator member (e.g., flexible mat 300) to locate the feet 216, 226 in predetermined positions, as shown in FIGS. 5 and 5-1. The mat 300 includes a series of protrusions 320 which form grooves 310 (e.g., sub-grooves within grooves 116(1)) that are configured to receive the feet 216, 226 of the dividers 210, 220. The grooves 310 may have rounded edges to facilitate insertion of the feet. The grooves 310 and/or protrusions 320 may be numbered or have other indicia (e.g., color-coded) to facilitate a user is locating the feet in a desired location. Referring to FIGS. 5, 6 and 7, the mat 300 may have a shape that matches an outline of the floor 116(2) such that the mat is received in the groove 116(1) on the bottom wall 116.

The mat 300 may be formed of a flexible silicone, soft rubber or other suitable material and may be dishwasher safe.

Figure 11:
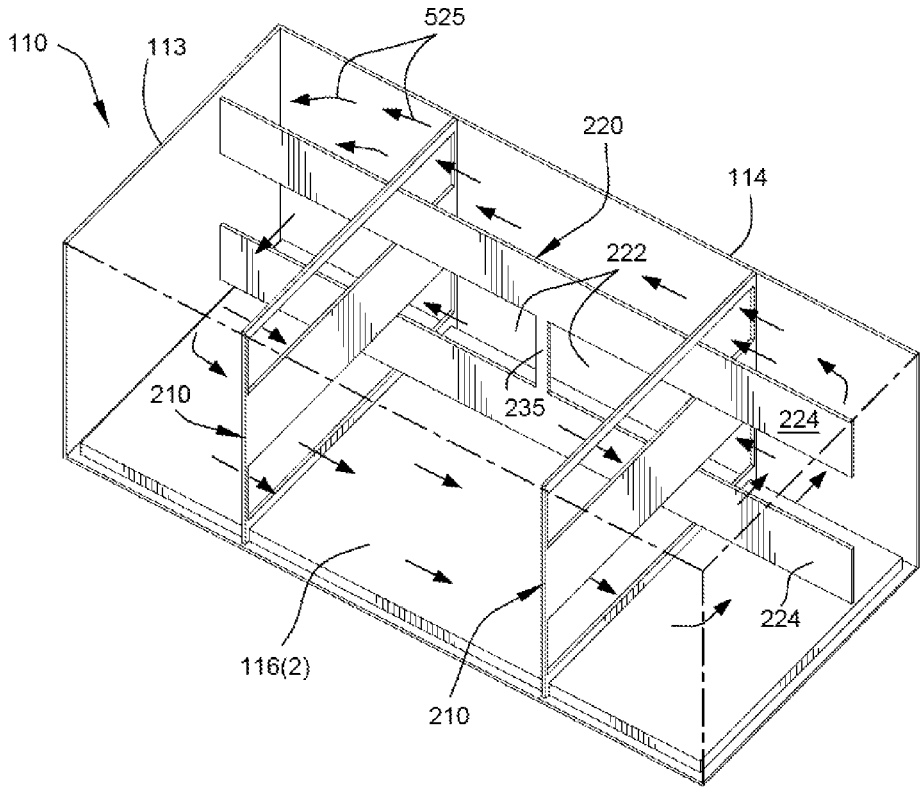
FIG. 11 is a perspective view of another example drawer of the refrigeration device of FIG. 1.

In another example shown in FIG. 11, the length divider 220 may include a support (or supports) 235 near a central portion of the length divider, instead of the supports 225 at end portions of the divider 220. This arrangement may facilitate insertion of the guide portions 224 into the width divider 210 as the slots 222 have an open configuration. Otherwise, the supports 225 may be pivotable, removable or have another configuration to facilitation connection of the dividers 210, 220. It is noted that the width divider may also be fitted with a support or supports that allow for open-ended slots 212.

Figure 10:
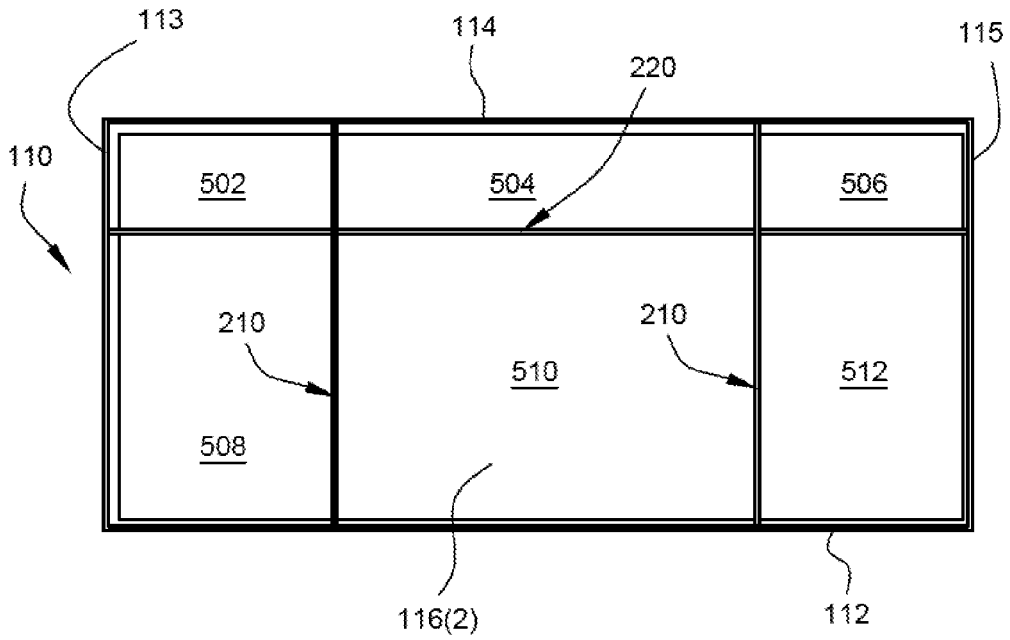
FIG. 10 is a plan view of the drawer of FIG. 2.

Now referring to FIGS. 10 and 11, the slots 212, 222 form openings which allow airflow 525 to circulate between each of the storage compartments 502, 504, 506, 508, 510, 512.

Thus, particularly in a refrigerated drawer, such arrangement facilitates proper storage of food items as the cooling air is able to reach each storage compartment.

Figure 12:
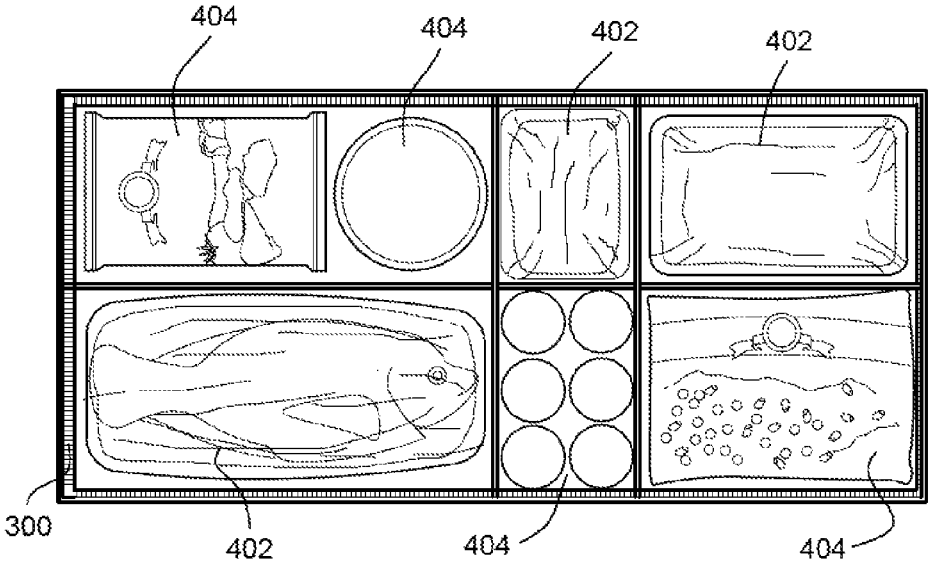
FIG. 12 is a plan view of an example drawer of the disclosed technology showing food items stored in the drawer.
Figure 13:
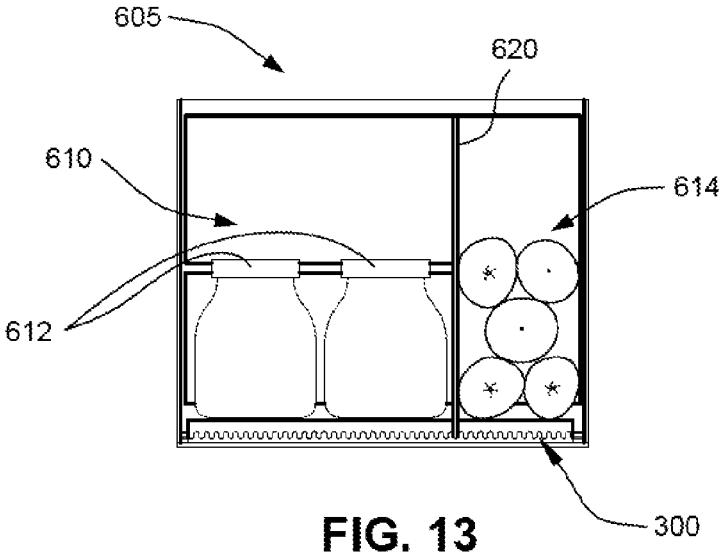
FIG. 13 is a side view of an example drawer of the disclosed technology showing food items stored in the drawer.

As shown in FIG. 12, the divider assembly 200 may be advantageous in allowing the dividers 210, 220 to be adjusted according to the size of certain food items while separating a first type of foot item 402 (e.g., meats) from a second type of food item 404 (e.g., non-meats).

In another example, a drawer 605 (e.g., a crisper drawer) in the cooling compartment 103 may include a divider assembly including a width divider 610 and a length divider 620 to separate a first type of food item 612 (e.g., in containers) from a second type of food item 614 (e.g., produce). The width divider may include relatively large slots while the length divider has relatively small slots. As a result, the produce 614 may be reliably confined on one side of the length divider 620, but may be permitted to travel through the width dividers 610.

While the examples discussed above have been described in connection with what are presently considered to be practical and preferred features, it is to be understood that appended claims are intended to cover modifications and equivalent arrangements included within the spirit and scope of these examples.

What is claimed is:

1. A refrigeration device, comprising:

a housing including an interior space;

a cooling unit to direct a cooling airflow into the interior space to cool the interior space;

a drawer to store items, the drawer including a bottom wall with a first pair of parallel grooves extending below a top surface of the bottom wall and a second pair of parallel grooves that are perpendicular to the first pair of parallel grooves and extend below the top surface, the drawer being slidably received in the housing;

a plurality of sub-grooves disposed within each of the first pair of parallel grooves and the second pair of parallel grooves; and a plurality of dividing walls to separate the drawer into at least three adjustable storage compartments, wherein each of the dividing walls comprises a material with a thickness and includes an opening formed through the thickness to slidably receive a portion of another dividing wall, and at least two feet that extend downward and are configured to slide horizontally within one of the first pair of parallel grooves and the second pair of parallel grooves, and wherein the openings are configured such that the cooling airflow is allowed to circulate through each of the at least three storage compartments.

2. The refrigeration device of claim 1, wherein the plurality of dividing walls includes at least three dividing walls.

3. The refrigeration device of claim 1, wherein the at least three adjustable compartments comprises at least six adjustable compartments.

4. The refrigeration device of claim 1, wherein each of the plurality of dividing walls has an elongate substantially planar configuration.

5. The refrigeration device of claim 1, wherein the plurality of dividing walls comprises a first dividing wall and a second dividing wall, the first dividing wall including at least one first slot extending through the first dividing wall and along a length direction of the first dividing wall, the second dividing wall including at least one second slot extending through the second dividing wall and along a length direction of the second dividing wall, wherein a portion of the first dividing wall is configured to extend through the second slot, and a portion of the second dividing wall is configured to extend through the first slot such that the first dividing wall is adjustable relative to the second dividing wall along the second slot and the second dividing wall is adjustable relative to the first dividing wall along the first slot.

6. A refrigeration device, comprising:

a housing including an interior space;

a cooling unit to cool the interior space;

a drawer to store food items, the drawer having a bottom storage surface and being slidably received in the housing, the bottom storage surface including a first pair of parallel grooves extending below the bottom storage surface and a second pair of parallel grooves that are perpendicular to the first pair of parallel grooves and extend below the bottom storage surface, and including a plurality of sub-grooves disposed within each of the first pair of parallel grooves and the second pair of parallel grooves; and a divider assembly disposed in the drawer, the divider assembly comprising:

at least one first divider having an elongate substantially planar configuration and comprising a material with a first thickness, the first divider including at least one first slot extending through the first thickness and along a length direction of the first divider and including a first foot and a second foot extending downward below the bottom storage surface into the first pair of parallel grooves and allowing horizontal adjustment of the at least one first divider; and at least one second divider having an elongate substantially planar configuration and comprising a material with a second thickness, the second divider including at least one second slot extending through the second thickness and along a length direction of the second divider and including a third foot and a fourth foot extending downward below the bottom storage surface into the second pair of parallel grooves and allowing horizontal adjustment of the at least one second divider, wherein a portion of the first divider is configured to extend through the second slot, and a portion of the second divider is configured to extend through the first slot such that the first divider is adjustable relative to the second divider along the second slot and the second divider is adjustable relative to the first divider along the first slot.

7. The divider assembly of claim 6, wherein the portion of the first divider is at least a first guide portion having at least one first guide surface, the portion of the second divider is at least one second guide portion having at least a second guide surface.

8. The divider assembly of claim 7, wherein the at least one first guide surface is configured to engage the at least one second guide surface.

9. The divider assembly of claim 8, wherein the at least one first guide surface is configured to slidably engage the at least one second guide surface when the first divider is adjusted relative to the second divider.

10. The divider assembly of claim 9, wherein the at least one second guide surface is configured to slidably engage the at least one first guide surface when the second divider is adjusted relative to the first divider.

11. The refrigeration device of claim 6, wherein the drawer includes a bottom wall to support the divider assembly, the bottom wall including a top surface.

12. The refrigeration device of claim 11, further comprising a locating member disposed on the bottom wall, the locating member including grooves extending below the top surface and configured to locate the first foot and the second foot of the first divider and the third foot and the fourth foot of the second divider.

13. A method of dividing a drawer space in a refrigerator, the method comprising:

providing the drawer space with a bottom storage surface, the bottom storage surface including a first pair of parallel grooves extending below the bottom storage surface and a second pair of parallel grooves that are perpendicular to the first pair of parallel grooves and extend below the bottom storage surface, and including a plurality of sub-grooves disposed within each of the first pair of parallel grooves and the second pair of parallel grooves providing at least one first divider in the drawer space of the refrigerator, the first divider having an elongate substantially planar configuration with a first thickness, the first divider including at least one first slot extending through the first thickness and along a length direction of the first divider and including a first foot and a second foot extending downward below the bottom storage surface of the drawer space into the first pair of parallel grooves and allowing horizontal adjustment of the at least one first divider;

providing at least one second divider in the drawer space of the refrigerator, the second divider having an elongate substantially planar configuration with a second thickness, the second divider including at least one second slot extending through the second thickness and along a length direction of the second divider and including a third foot and a fourth foot extending downward below the bottom storage surface into the second pair of parallel grooves and allowing horizontal adjustment of the at least one second divider;

positioning a portion of the first divider to extend through the second slot, and positioning a portion of the second divider to extend through the first slot; and at least one of adjusting the first divider relative to the second divider along the second slot and adjusting the second divider relative to the first divider along the first slot.

14. The method of claim 13, wherein the portion of the first divider is at least a first guide portion having at least one first guide surface, the portion of the second divider is at least one second guide portion having at least a second guide surface.

15. The method of claim 14, wherein the at least one first guide surface is configured to engage the at least one second guide surface.

16. The method of claim 15, wherein the at least one first guide surface is configured to slidably engage the at least one second guide surface when the first divider is adjusted relative to the second divider.

17. The method of claim 16, wherein the at least one second guide surface is configured to slidably engage the at least one first guide surface when the second divider is adjusted relative to the first divider.

18. The method of claim 13, wherein the drawer space is a refrigerated drawer space configured to store food items.

19. The method of claim 13, further comprising positioning a locating member in the drawer space, the locating member including grooves extending below a top surface of a bottom wall of the drawer space to locate the first foot and the second foot of the first divider and the third foot and the fourth foot of the second divider.

20. The refrigeration device of claim 1, wherein the plurality of sub-grooves are perpendicular to the first pair of parallel grooves or the second pair of parallel grooves in which the sub-grooves are disposed.

21. The refrigeration device of claim 1, wherein the sub-grooves are configured to accept the feet.

22. The refrigeration device of claim 1, wherein the first pair of parallel grooves and the second pair of parallel grooves together define a periphery of the bottom wall.

* * * * *